US010960437B2

(12) United States Patent
Cappozzo

(10) Patent No.: US 10,960,437 B2
(45) Date of Patent: Mar. 30, 2021

(54) DISC SCREEN FOR THE SEPARATION OF SOLID MATERIALS

(71) Applicant: ECOSTAR S.R.L., Sandrigo (IT)

(72) Inventor: Domenico Cappozzo, Sandrigo (IT)

(73) Assignee: ECOSTAR S.R.L., Sandrigo (IT)

( * ) Notice: Subject to any disclaimer, the term of this patent is extended or adjusted under 35 U.S.C. 154(b) by 119 days.

(21) Appl. No.: 16/175,874

(22) Filed: Oct. 31, 2018

(65) Prior Publication Data

US 2019/0126318 A1 May 2, 2019

(30) Foreign Application Priority Data

Oct. 31, 2017 (IT) ..... 102017000124190

(51) Int. Cl.

| | |
|---|---|
| ***B07B 1/15*** | (2006.01) |
| ***B07B 13/16*** | (2006.01) |
| ***B07B 1/00*** | (2006.01) |
| ***B02C 23/08*** | (2006.01) |
| ***B07B 1/30*** | (2006.01) |
| ***B07B 1/42*** | (2006.01) |
| ***B07B 1/46*** | (2006.01) |

(52) U.S. Cl.

CPC ..... *B07B 1/15* (2013.01); *B02C 23/08* (2013.01); *B07B 1/005* (2013.01); *B07B 1/30* (2013.01); *B07B 1/42* (2013.01); *B07B 1/46* (2013.01); *B07B 13/16* (2013.01)

(58) Field of Classification Search

CPC .. B07B 1/15; B07B 1/005; B07B 1/30; B07B 1/42; B07B 1/46; B07B 13/16; B02C 23/08

See application file for complete search history.

(56) References Cited

U.S. PATENT DOCUMENTS

| | | | | |
|---|---|---|---|---|
| 5,501,343 | A | 3/1996 | Hadden | |
| 7,578,396 | B1 * | 8/2009 | Garzon | B07B 1/15 209/667 |
| 8,136,670 | B2 * | 3/2012 | Garland | B07B 11/06 209/235 |
| 8,783,443 | B2 * | 7/2014 | Erkkila | B65G 41/007 198/506 |
| 9,481,013 | B2 * | 11/2016 | Anderson | B07B 1/005 |
| 2004/0140381 | A1 * | 7/2004 | Rose | B07B 13/16 241/79.3 |
| 2008/0121744 | A1 * | 5/2008 | Majuri | B07B 1/005 241/101.77 |
| 2009/0173671 | A1 * | 7/2009 | O'Keeffe | B07B 1/46 209/421 |
| 2013/0037453 | A1 * | 2/2013 | Schirm | B07B 13/16 209/247 |

FOREIGN PATENT DOCUMENTS

| | | |
|---|---|---|
| DE | 620885 | 10/1935 |
| EP | 1745860 | 1/2007 |

* cited by examiner

*Primary Examiner* — Patrick H Mackey
(74) *Attorney, Agent, or Firm* — Mark M. Friedman

(57) ABSTRACT

Disc screen for the separation of solid residues, provided with a plurality of parallel rotating shafts each carrying a plurality of discs and defining a screening plane for treating residues between an input section and an output section. A movable hopper is provided for, slidable along an advancement direction of the residues, above the screening plane, provided with an outlet door which can supply the screening plane in different positions.

10 Claims, 13 Drawing Sheets

DISC SCREEN FOR THE SEPARATION OF SOLID MATERIALS

FIELD OF APPLICATION

The present invention regards a disc screen for the separation of solid materials, according to the preamble of the independent main claim.

The disc screen in question is designated to be used, in a per se conventional manner, for the separation of solid materials of various types, such as for example: urban solid waste, fluvial inerts, products of organic fractions of sorted waste collection, compost (for refinement thereof), recycled wood, biomass, inert material, demolition material, land and landfills reclamation material, glasses, plastic, metal scrap and still other materials.

The disc screen according to the invention is thus part of the industrial solid residues treatment industry and it is advantageously intended to be installed downstream or upstream of systems for grinding or crushing the residues.

STATE OF THE ART

Hereinafter, the term "residues" will be used indistinguishably and for the sake of brevity to indicate any solid material that requires to be separated in the components thereof, based on the dimensions and/or mass.

Movable or roll-off disc screens that enable to reach recycling centers, material sieving areas, landfills or mobile worksites are known in the market.

Such screens are generally provided with a support structure, which is directly placed on the ground should the screen be of the roll-off type, and which mounts—at the lower part—tracks in case of a screen of the movable type.

Furthermore, the screen is provided with a plurality of parallel rotating shafts rotatably mounted on the support structure and carried in rotation around the axis thereof by a chain connected to a motor.

A plurality of discs, which are spaced from each other by a plurality of sleeves, are mounted axially in succession along the rotating shafts.

A lower conveyor belt for collecting the fraction of smallest residues separated by the discs of the screen is then provided for beneath the shafts.

The shafts with the discs define the screening plane of the screen.

The screen further comprises two evacuation conveyor belts mounted on bracket-like frameworks projecting outwards and associated to the support structure of the screen at the outlet of the lower conveyor belt and at the outlet of the plurality of screening shafts.

Operatively, the upper screening plane receives, generally from a grinder, a continuous flow of residual material to be treated which provides for separating—mainly as a function of the dimensions—into two fractions one of which consists of coarser material and one consisting of finer material, the separated fractions being moved away on the two discharge conveyor belts.

The discs and the sleeves of the shafts mutually define the dimensions of the screening section i.e. the residual material separation dimensions.

In order to vary the screening section, it is known to modify the rotation speed of the shafts, or vary the distance between the discs by replacing the spacer sleeves or even change the distance between centers between the shafts but, in this case, having to carry out major structural modifications and in particular changing the chain transmission means.

An example of a disc screen of the known type, though not actually of the movable type, is described in the German patent DE 620885 C.

The movable or roll-off screens of the known type generally described herein concretely revealed some drawbacks.

A first drawback lies in the fact that the screen operates optimally if supplied in a continuous and uniform manner. Should there arise the need to screen a heap of residual product, there arises the need for providing an external hopper for creating a continuous flow and supplying the screening plane by means of such flow.

Such technical solution is burdening and complex and entails long times for installing the screen loading system, thus considerably impacting the cost of the screening process.

A further drawback lies in the fact that the grinding and crushing systems have conveyor belts for discharging the ground products which do not meet standardized characteristics and thus which are not always suitable for loading the screening plane in the best manner possible, thus requiring modifications to the belts of the grinding or crushing systems, or installing dedicated conveyor belts, otherwise one has to settle for a non-optimal loading for example with part of the ground material falling off from the conveyor belt.

Furthermore, it should be borne in mind that the flow rate of the material to be treated must be constant and appropriate to the length of the screening plane. Furthermore, the speed of the discs must be conveniently modified upon the variation of the dimensions of the residual material to be treated so as to allow the variation of the screening action.

The current movable or roll-off screens—even when supplied by the grinding or crushing systems—have the further drawback of not allowing to adjust the flow rate for supplying the screening plane.

The current movable or roll-off screens also reveal the further drawback of not having the operative versatility such as for example not being capable of choosing whether to operate with two or three screen fractions having a single operative mode. Even when supplied by the grinding or crushing systems, they have the further drawback of not allowing to adjust the flow rate of supply to the screening plane.

PRESENTATION OF THE INVENTION

Thus, in this situation, the problem underlying the present invention is to overcome the problems of the aforementioned prior art, by providing a disc screen for the separation of solid materials, which can be adapted in a versatile manner to the needs encountered in recycling centers, in material sieving areas, landfills or mobile worksites.

Another object of the present invention is to provide a disc screen for the separation of solid materials, which allows to supply the screening plane in an optimal manner.

Another object of the present invention is to provide a disc screen for the separation of solid materials, which is easily transportable by a truck.

Another object of the present invention is to provide a disc screen for the separation of solid materials, which allows to separate residues into two or three fractions.

Another object of the present invention is to provide a disc screen for the separation of solid materials, which allows displacing the screen in an extremely quick manner and perform an operation with high versatility.

Another object of the present invention is to provide a disc screen for the separation of solid materials, which allows loop treatment with a grinding or crushing system.

Another object of the present invention is to provide a disc screen for the separation of solid materials, which is operatively entirely reliable.

Another object of the present invention is to provide a disc screen for the separation of solid materials, which can be used in a versatile manner in different fields of application.

BRIEF DESCRIPTION OF THE DRAWINGS

The technical characteristics of the finding, according to the aforementioned objects, are clearly observable from the content of the claims outlined below and the advantages thereof will be more apparent from the detailed description that follows, provided with reference to the attached drawings, which represent some embodiments thereof purely by way of non-limiting purposes, wherein:

FIG. 13 having some parts made transparent to show the sliding guide of the movable portion of such covers.

DETAILED DESCRIPTION OF A PREFERRED EMBODIMENT

Figure 1:
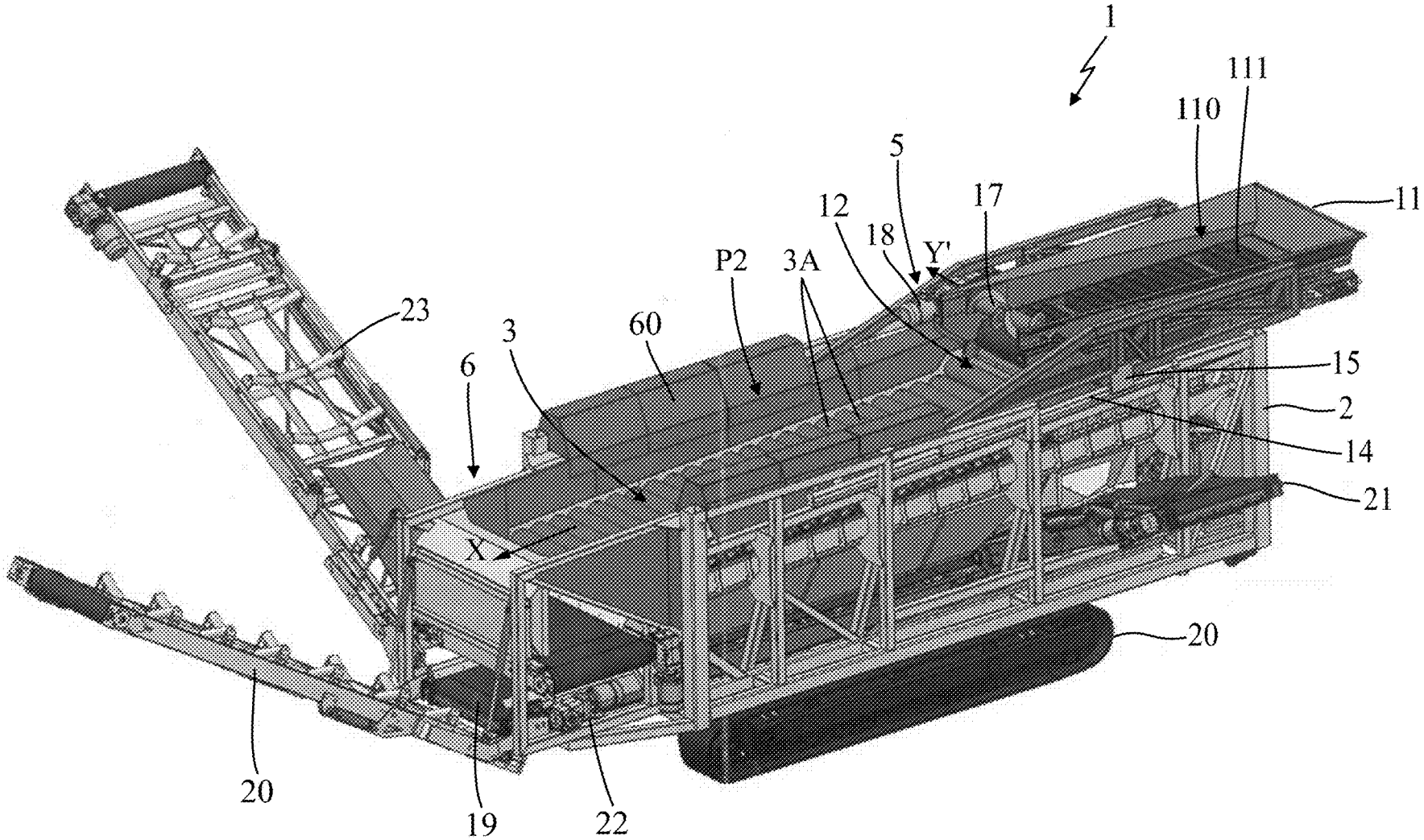
FIG. 1 shows a perspective image of a first embodiment of the disc screen for the separation of solid materials, according to the present invention.

With reference to the attached drawings, a movable disc screen for the separation of solid materials, subject of the present invention, is indicated in its entirety with 1.

The screen 1 according to the invention is suitable to be used for separating solid materials of various types such as for example: urban solid waste, fluvial inerts, products of the organic fractions of sorted waste collection, compost (for refinement thereof), recycled wood, biomass, inert material, demolition material, land and landfills reclamation material, glasses, plastic, metal scrap and still other materials.

The movable screen 1 may be provided with its own tracks like in the example illustrated in the attached figures or it may be considered moveable in that it is of the roll-off type.

The mobility of the screen, subject of the present invention, allows it to reach recycling centers, material sieving areas, landfills or mobile worksites.

As schematically represented in the attached figures, the disc screen 1 comprises a support structure 2, intended to rest against the ground, directly or through tracks 20, and on which a plurality of rotating shafts 3 parallel and spaced from each other, are rotatably mounted.

The rotating shafts 3 have longitudinal extension axes, indicated with Y, which define the laying of a screening plane P preferably substantially horizontal, as illustrated in the drawings, but which can also take an inclination without departing from the scope of protection of the present patent.

A drive system 4 is provided that is suitable to rotate the shafts 3 in order to displace the residues along an advancement direction X from an input section 5 to an output section 6.

The aforementioned screening plane P extends with an elongated shape along an advancement direction X of the residues between the aforementioned input section 5 and the aforementioned output section 6.

According to a preferred embodiment of the invention and in a per se conventional manner, the drive system 4 comprises an electric motor 4*a* and motion transmission mechanically connected to the electric motor 4*a*. Such motion transmission in turn comprises a chain loop-wound and engaged with a pinion fixed to the shaft of the motor 4*a* and to gearwheels splined on each rotating shaft 3.

The screen 1 further comprises a plurality of discs 8, which are mounted axially in succession along the rotating shafts 3 to receive the rotary motion therefrom.

Figure 7:
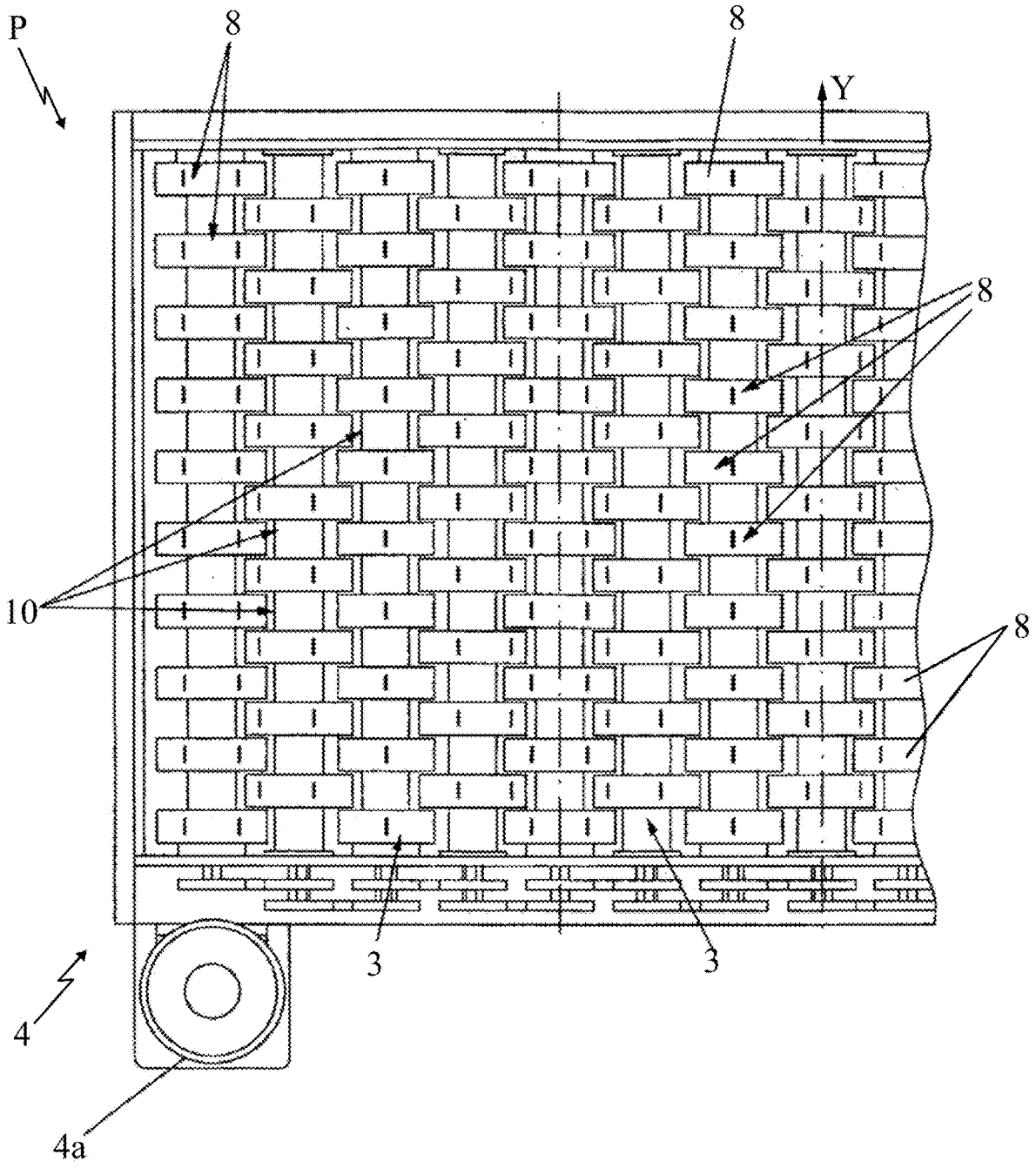
FIG. 7 shows an enlarged detail of the screen of FIG. 1 in a plan view and regarding a portion of the screening plane with some rotating shafts having a plurality of discs mounted.

More in detail, a group of discs 8 which for example—according to enclosed FIG. 7—could be formed by nine or ten discs on adjacent shafts in succession, is mounted on each rotating shaft 3.

The discs 8 of each group of discs are mounted spaced from each other along the extension of the longitudinal axis Y of the rotating shaft 3.

Furthermore, the screen 1 is also advantageously provided with a plurality of sleeves 10, each of which idly mounted on a respective rotating shaft 3 between two discs 8 in succession.

The discs 8 are instead differently mechanically rotatably coupled to the rotating shaft 3 to receive the rotary motion therefrom.

Functionally, when the screen 1 is operative, the motor 4*a*—through the chain loop-wound on the pinion of the drive shaft and on the gearwheels of the rotating shafts 3—drives the rotating shafts 3 in rotation in the same direction that brings them to rotate the discs 8 which— impacting with the residues—cause the thrust advancement thereof along the screening plane in the advancement direction X from the input section 5 to the output section 6.

During such advancement of the residues, those with grain size smaller than the openings (screening section) defined between the discs 8 and the sleeves 10 fall—by gravity—beneath the screening plane, thus obtaining the selection of the materials substantially as a function of their size (and—to a lesser extent—as a function of their mass which makes them advance more or less bouncing between the discs 8).

According to the idea on which the present invention is based, the screen 1 further comprises a movable hopper 11 slidably mounted on the support structure 2 along the advancement direction X of the residues, above the screening plane P.

The movable hopper 11 is provided with an outlet door 12, which supplies the screening plane P along the advancement direction X of the residues.

A displacement system 13 is also provided which is suitable to displace the movable hopper 11 along the advancement direction X of the residues to position the outlet door 12 thereof in different loading positions along the screening plane P.

Thanks to the movable hopper 11, the residues can be treated on a longer or shorter path so as to optimize the selection of the residues, also depending on the variation of the flow rate or of the characteristics and dimensions of the residues.

According to a preferred embodiment of the present invention, the displacement system 13 comprises at least one track 14, and preferably two lateral tracks, each mounted on the support structure 2 and engaged in at least one corresponding guide 15 fixed to the movable hopper 11.

The tracks and the guides can obviously can be arranged in an entirely equivalent manner in an inverted position with respect to the hopper and the support structure 2.

The displacement system 13 further comprises at least one linear actuator 16, and preferably two lateral linear actuators, each connected to the support structure 2 and to the movable hopper in order to displace the latter along the advancement direction X, making it slide with the guides 15 in the tracks 14.

According to an advantageous characteristic of the screen, subject of the present invention, the movable hopper 11 comprises—at the outlet door 12—an auger 17, mounted transversely to the advancement direction X, along an axis Y', and actuated to rotate by an electric motor 18.

The outlet door 12 of the auger remains defined between the bottom 110 of the hopper 11 and the auger 17. Furthermore, the auger 17 is mounted at an adjustable height with respect to the bottom 110 to vary the dimensions of the residues outlet door 12. Otherwise, according to the example of FIGS. 8-13, the auger 17 can be adjusted in the position thereof with respect to the front end of the discharge 112 of the bottom 110 of the hopper, remaining at a predefined height with respect to the bottom 110 to vary the dimensions of the residues outlet door 12 which—as mentioned—remains defined with respect to the front end 112 of the bottom 110 of the movable hopper 11. Horizontal guides 70 are provided on the sides of the hopper. Along such guides, the auger 17 can be displaced in order to be fixed in the various positions with locking systems, e.g. consisting of screws.

The bottom 110 is advantageously obtained with a plurality of rollers 111 actuated to rotate by a motor—not visible in the attached drawings—through a transmission chain connected to gearwheels splined on the rollers, the rollers pushing the inerts towards the auger 17.

Otherwise, the bottom may be obtained with a conveyor belt (visible in FIGS. 10-13).

Thus, the auger 17—through the speed thereof and/or through the position thereof—controls the flow rate of the residues with which the screening plane P is to be loaded.

According to a preferred embodiment, the plurality of rotating shafts 3 comprises—starting from the input section 5—a first series of rotating shafts 3A, which are provided with a first screening section and define a first portion P1 of the screening plane P, and a second series of rotating shafts 3B, which are provided with a second screening section and define a second section P2 of the screening plane P.

The first and the second series of rotating shafts 3A and 3B have different screening sections so as to produce two different sections of residues which pass through the screening plane P. The movable hopper 11 can be actuated to move—by the displacement system 13—between at least one first operative position A, in which it supplies the first portion P1 of the screening plane P, and a second operative position B, in which it supplies the second portion P2 of the screening plane P.

The first screening section of the first portion P1 of the screening plane P is advantageously smaller than the second screening section of the second portion P2 of the screening plane P, so that the screening plane P as a whole—which treats the residues in succession—selects the finest material using the first screening section first, and then the coarser material using the second screening section, a larger residue remaining in the top screen of the screening plane P.

Figure 2:
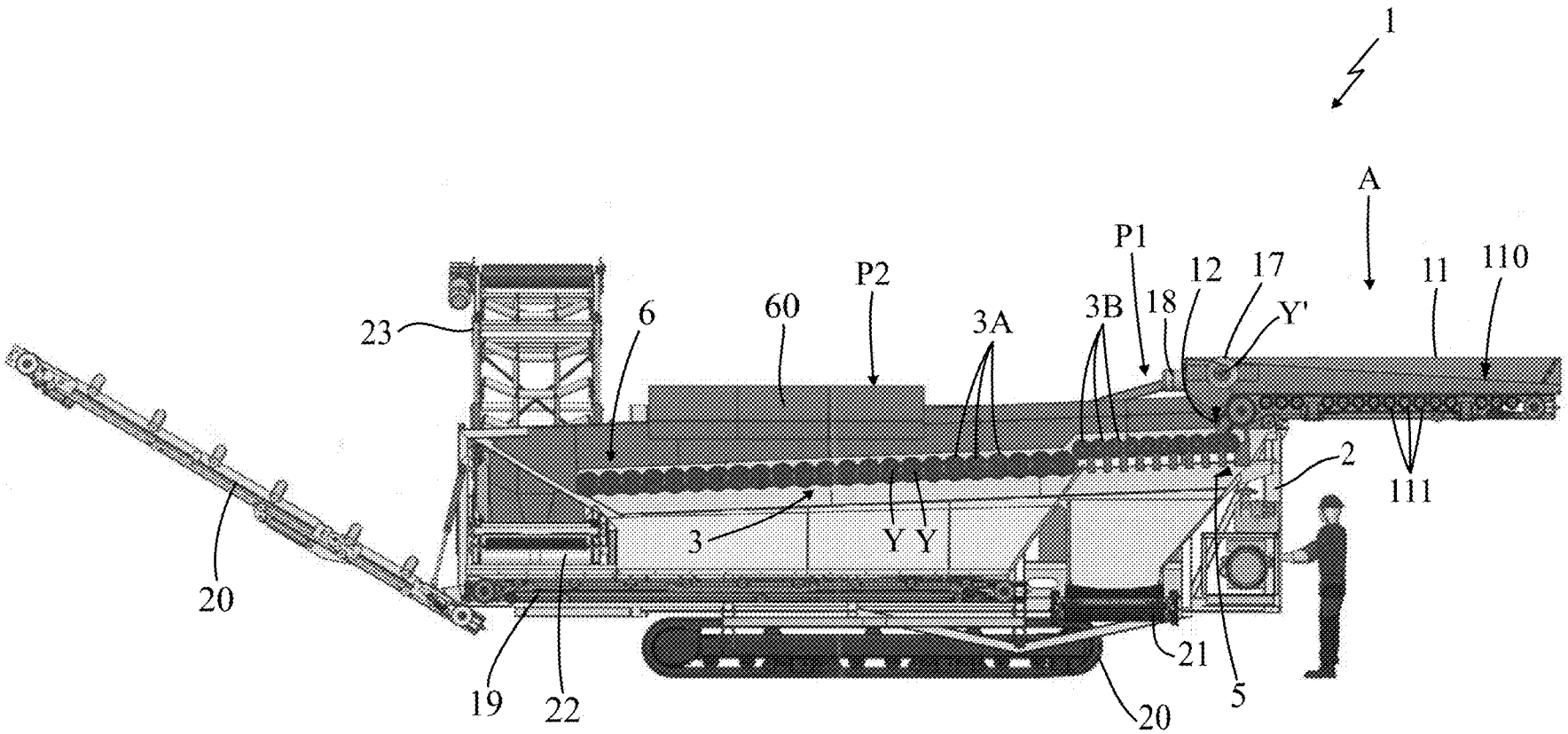
FIG. 2 shows the screen of FIG. 1 in a first lateral view with a movable hopper arranged in a first operative position in which it supplies a first portion of the screening plane.
Figure 8:
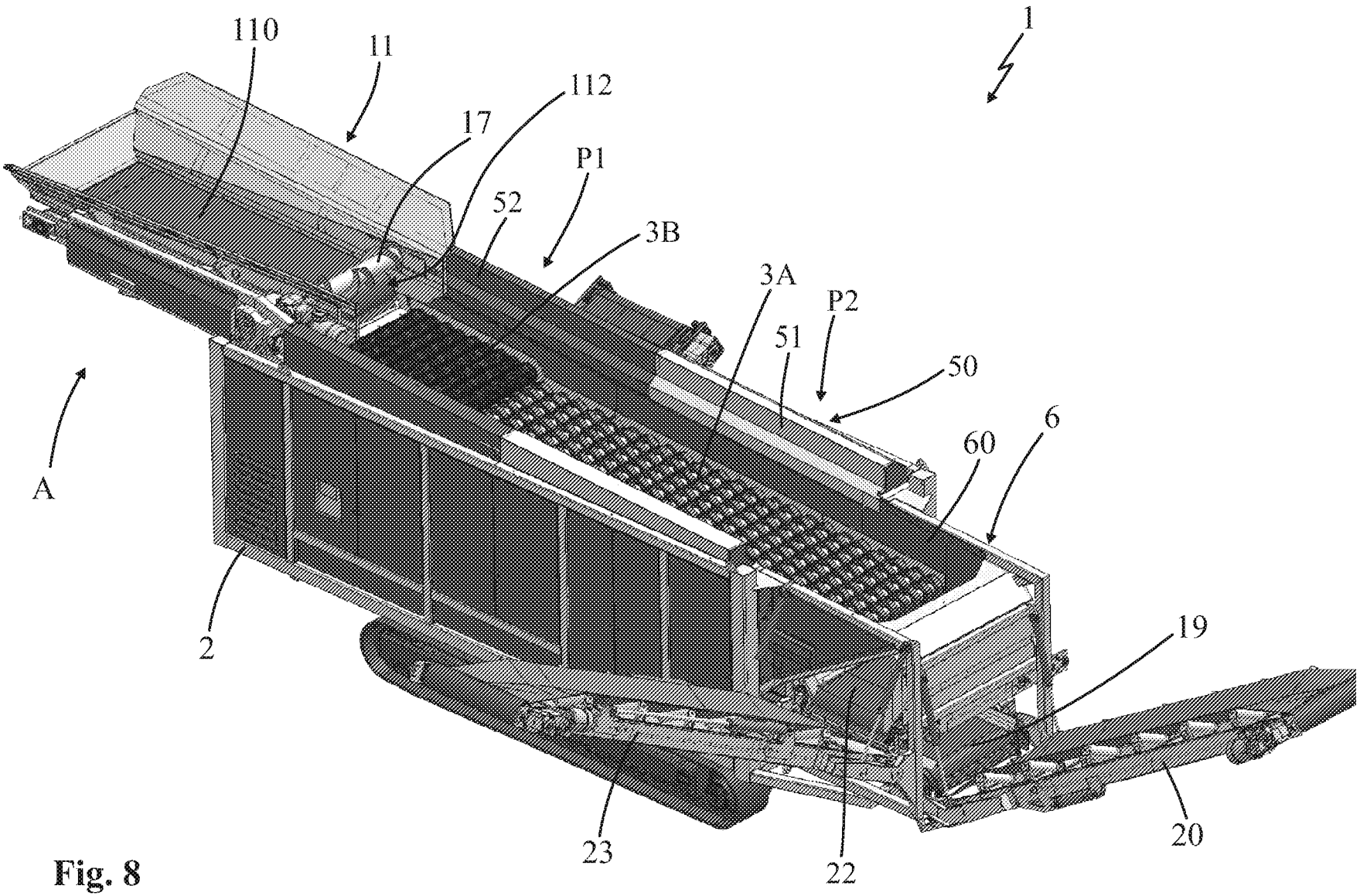
FIG. 8 shows a perspective image of a second embodiment of the disc screen for the separation of solid materials, according to the present invention with the movable hopper arranged in the first operative position in which it supplies a first portion of the screening plane.
Figure 9:
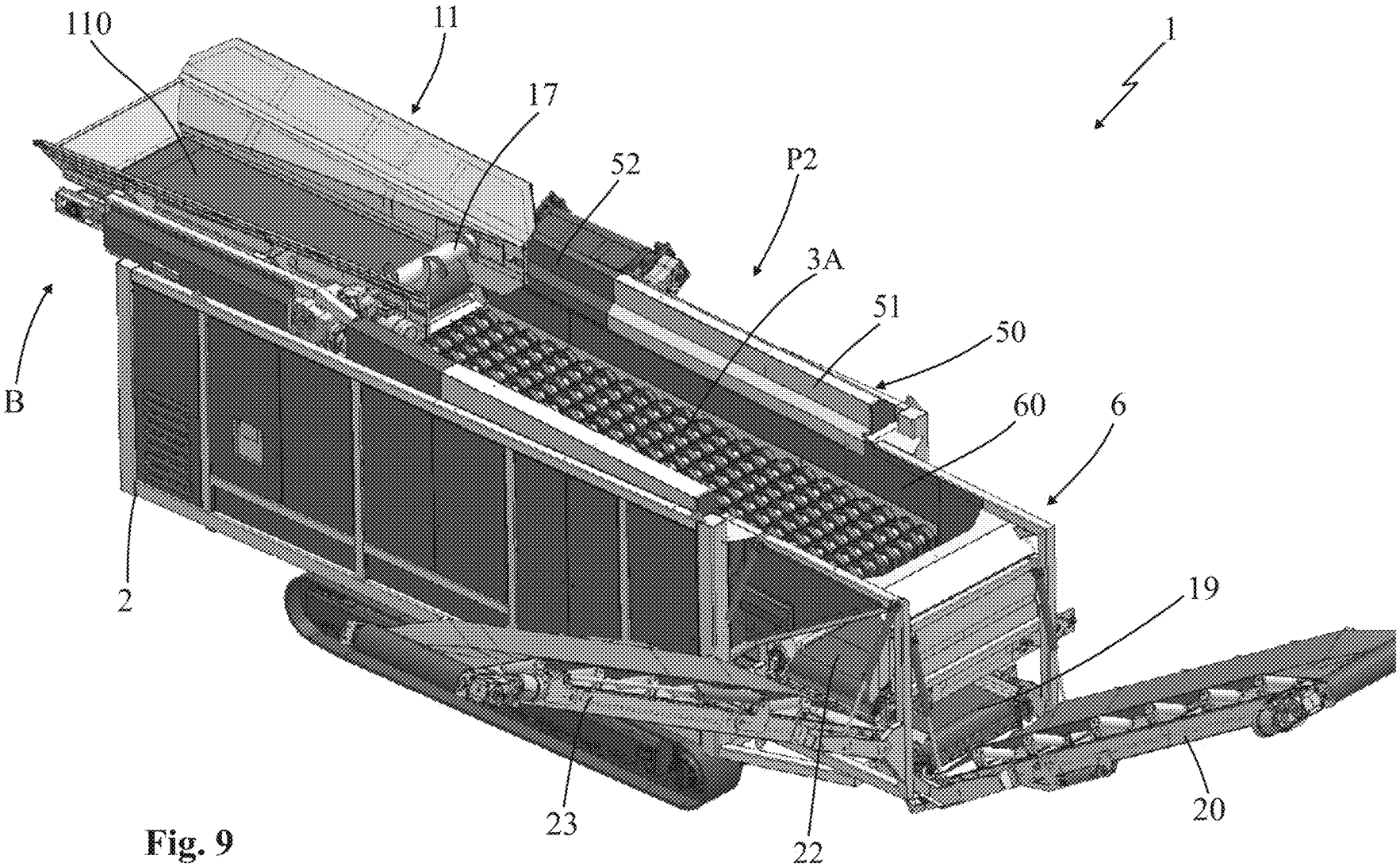
FIG. 9 shows the screen of FIG. 8 in a second perspective view with the movable hopper arranged in a second operative position in which it supplies a second portion of the screening plane.
Figure 10:
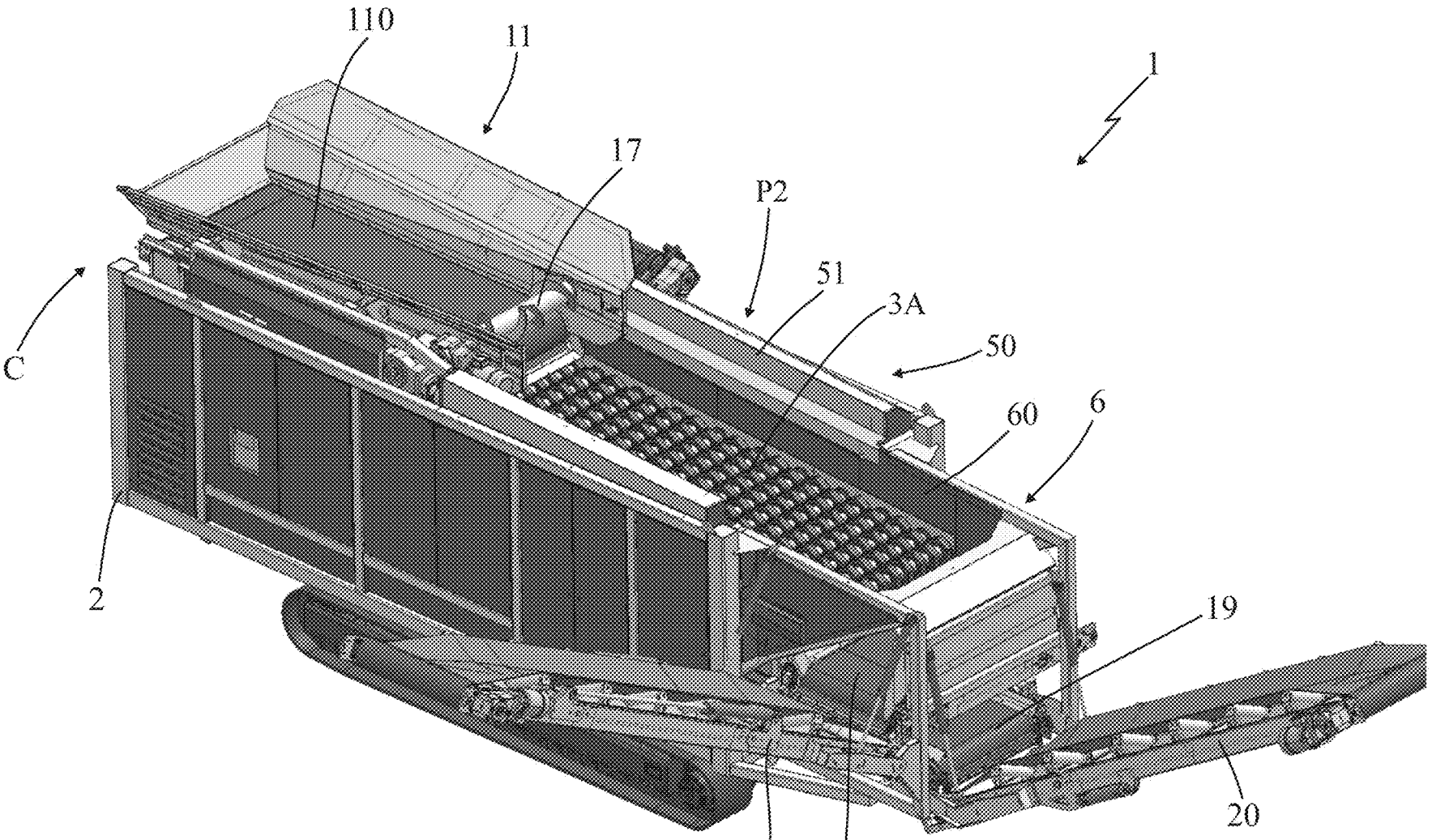
FIG. 10 shows the screen of FIG. 8 in a third perspective view with the movable hopper arranged in a third operative position in which it supplies the second portion of the screening plane and in which it takes a compact configuration, that can be used for transportation for example.

Advantageously, in the first operative position A for example shown in FIGS. 2 and 8, the movable hopper 11 has the maximum bracket-like projection from the support structure 2.

Figure 4:
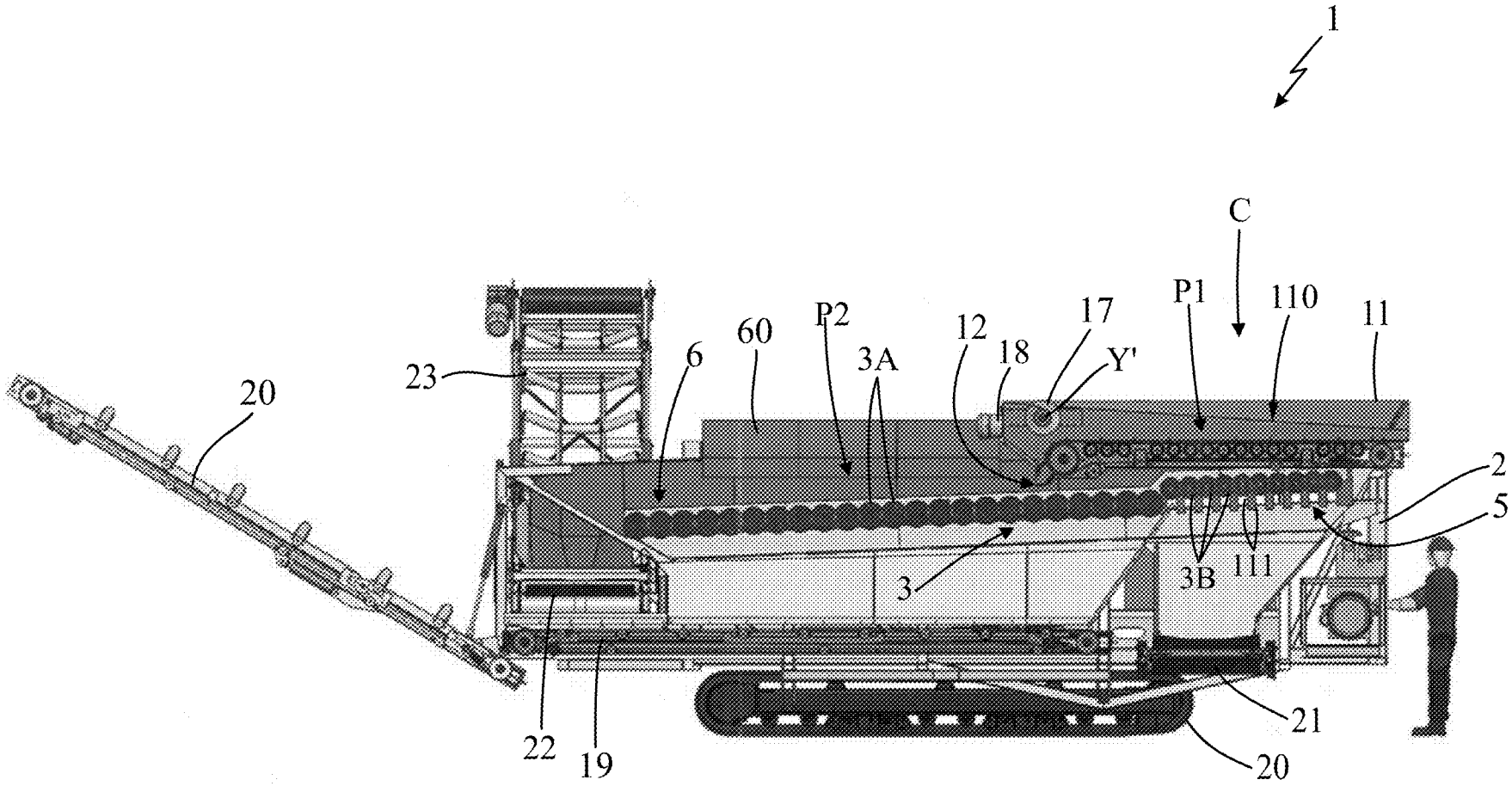
FIG. 4 shows the screen of FIG. 1 in a third lateral view with a movable hopper arranged in a third operative position in which it supplies the second portion of the screening plane and in which it takes a compact configuration.
Figure 5:
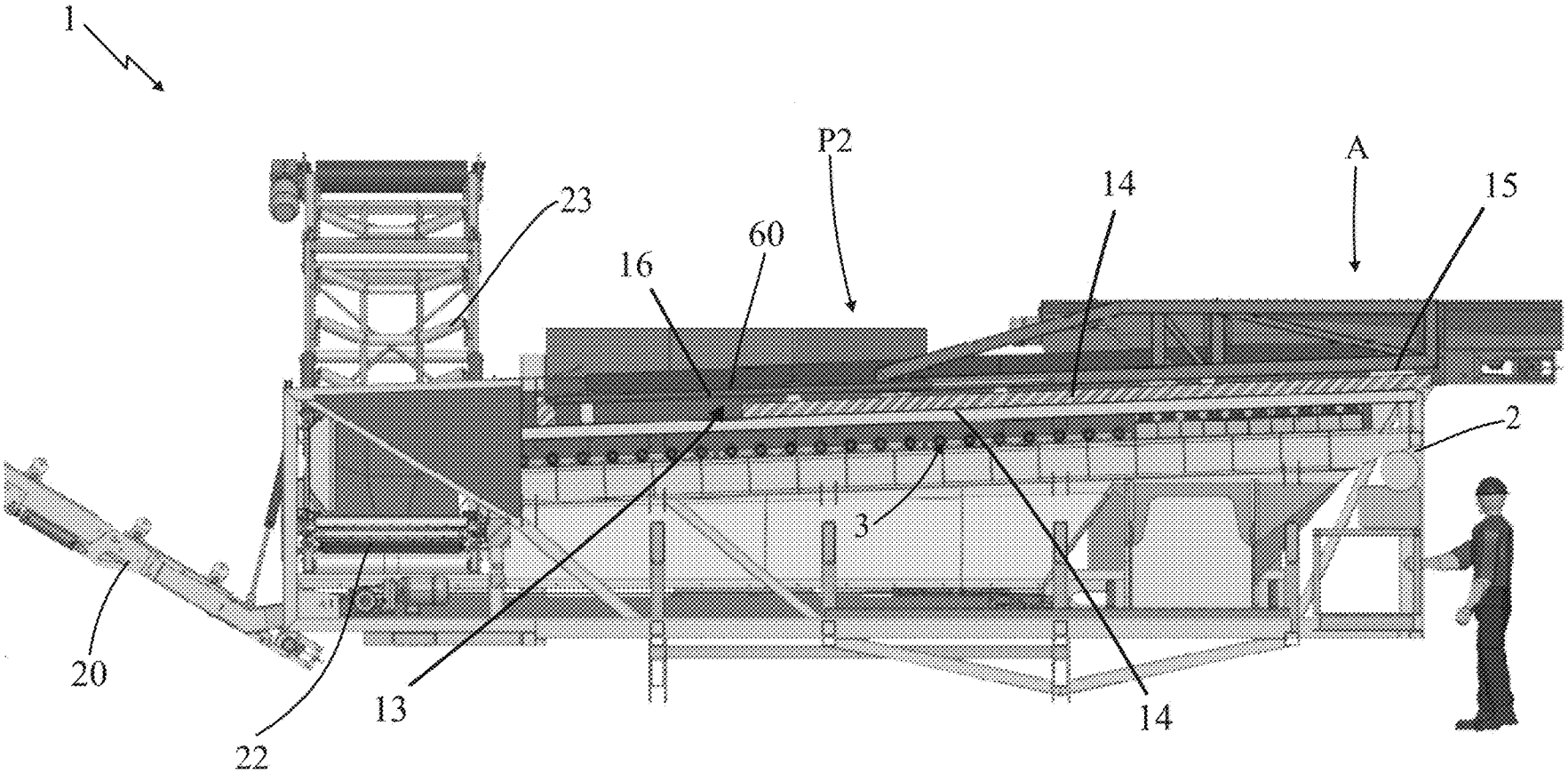
FIG. 5 shows a portion of the screen of FIG. 1 in a fourth enlarged lateral view with some parts removed so as to show others better and in particular the hopper displacement system.

Advantageously, the movable hopper 11 can also be displaced in a transportation position C (see FIGS. 4 and 10), in which it fully recedes into the overall size of the support structure 2 of the screen.

Figure 3:
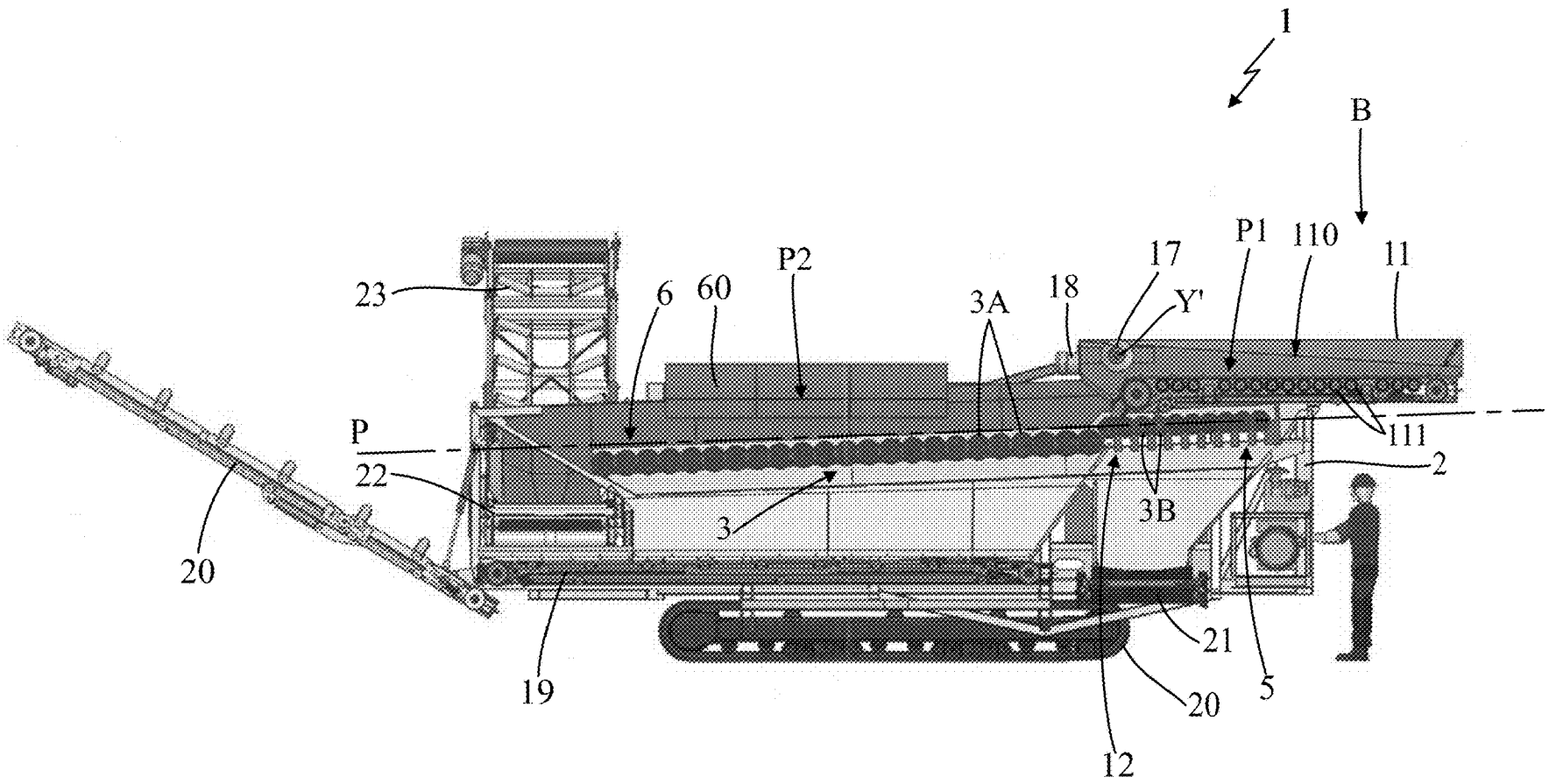
FIG. 3 shows the screen of FIG. 1 in a second lateral view with a movable hopper arranged in a second operative position in which it supplies a second portion of the screening plane.

Furthermore, in the second operative position B (see FIGS. 3 and 9) the movable hopper 11 projects from the support structure 2 by an intermediate length.

Figure 11:
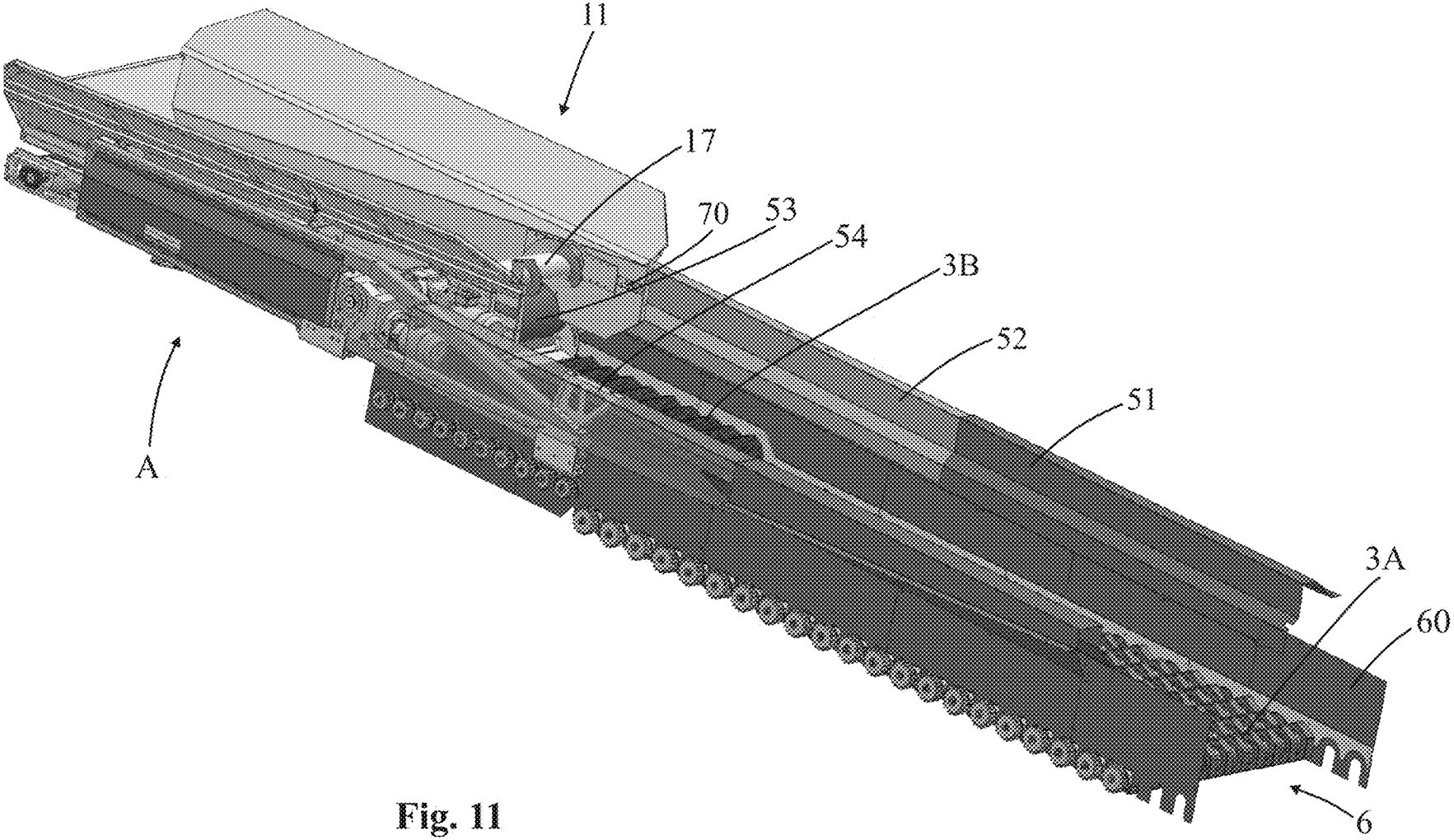
FIGS. 11, 12 and 13 show a detail of the screen of FIG. 8 respectively in the operating positions of FIGS. 8, 9 and 10 regarding telescopic covers connected to the movable hopper.
Figure 12:
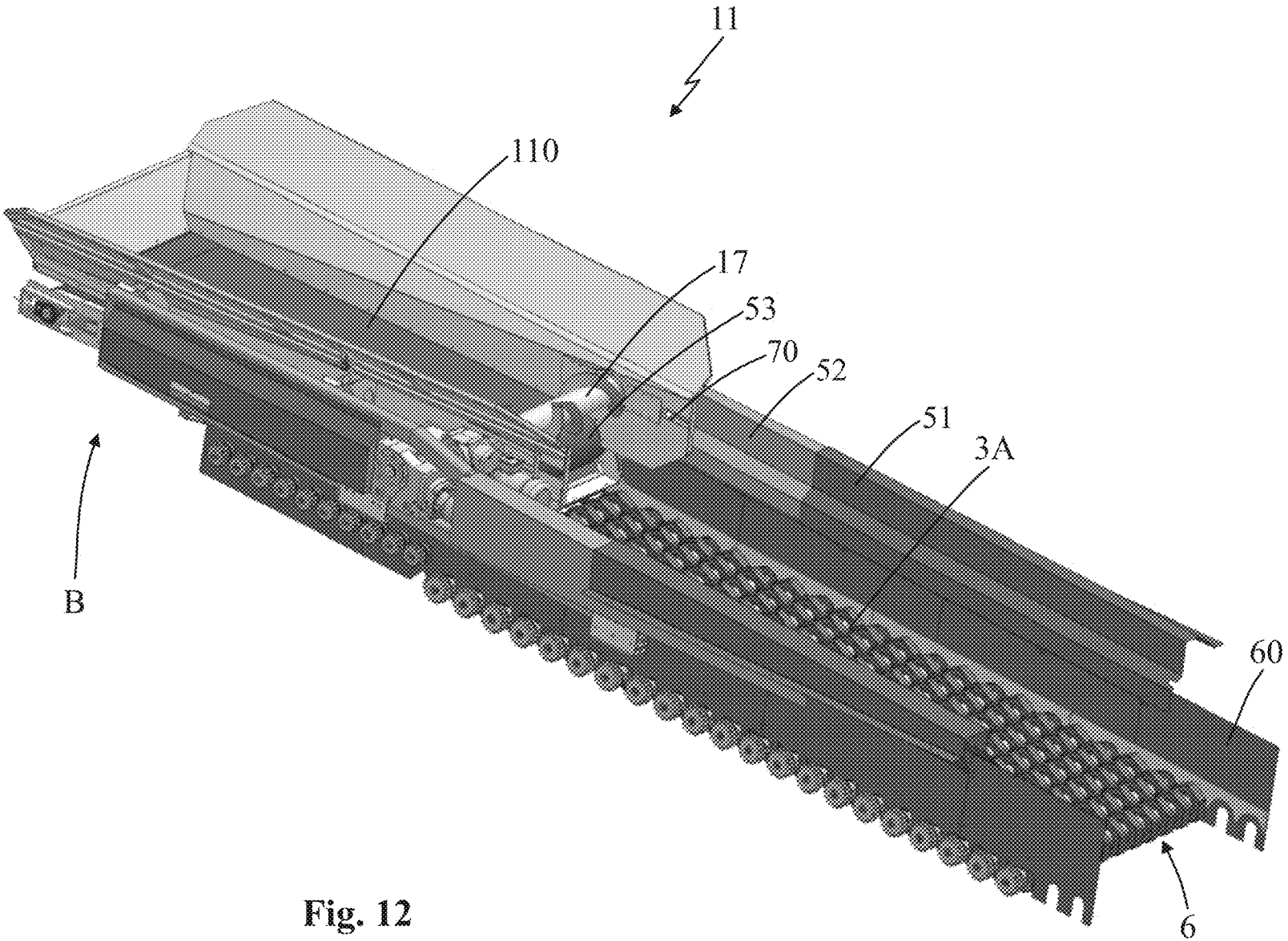
Figure 13:
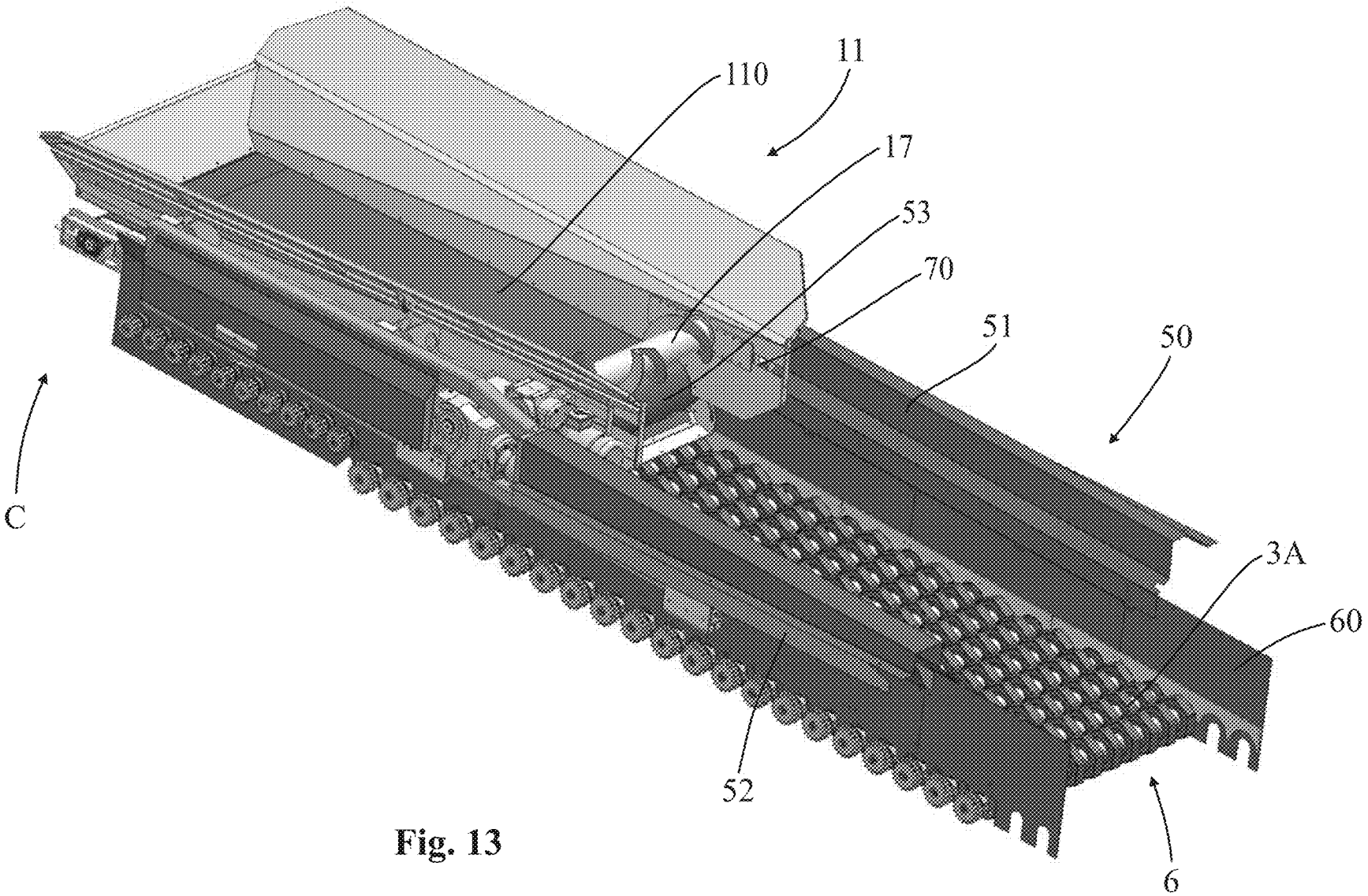

According to an advantageous characteristic of the present invention illustrated in FIGS. 11-13, telescopic covers 50 are provided for lifting the lateral edges 60 of the screening plane P, maintaining a connection with the movable hopper 11 according to the variation of the position of the latter. More in detail, the telescopic covers 50 are for example made of shaped sheet, and comprise a fixed portion 51, fixed to the lateral edges 60 of the screening plane P, preferably arranged at a median position of the screening plane P, and a movable portion 52 connected to the movable hopper 11 and susceptible to be slidably guided (for example see the slides 54 in FIG. 11 on which an upper concave portion of the movable portion 52 slides) along the fixed portion 51 of the covers 50 to connect the movable hopper 11 to the fixed portion 51.

Alternatively, the cover 50 can be of the non-telescopic type but having only one movable portion 52, slidably mounted on the lateral edges 60 of the screening plane in this case.

Thus, thanks to this distinctive trait of the present invention, simply moving the hopper to and fro not only allows optimizing the selection process as a function of the characteristics of the residue and the flow rate of such residue coming for example from a grinding system, but it also allows breaking it down into three different fractions, one of which is the larger material exiting from the output section of the screening plane P and the other two portions are selected by the two different portions of the screening plane P.

The movable hopper 11 preferably has lateral edges that can be extended by means of plungers to increase the loading capacity thereof, to three cubic meters for example.

Advantageously, as mentioned above, the first portion P1 of the screening plane P has a smaller screening section than that of the second section P2 for example for the preliminary removal of dust or very fine material from the residual mass.

Once the residues have been separated, they are transported and removed from the screen as specified hereinafter according to a possible advantageous embodiment.

In order to remove the residues which passed through the second portion P2 of the screening plane P (i.e. the one advantageously represented in the figures as the most extended portion of the screening plane P), a first conveyor belt 19 is provided, arranged beneath the second portion P2 of the screening plane P to receive the residues therefrom, and a first discharge belt 20 is provided, which receives the residues from the first conveyor belt 19, to conduct them outside the screen. Such first discharge belt 20 is substantially aligned with the first conveyor belt 19 along the advancement direction X or along the direction of greater extension of the screen 1.

Thus, a second discharge belt 21, which is arranged beneath the first portion P1 of the screening plane P, is provided substantially transversely with respect to the advancement direction X, in order to conduct the residues that passed through the first portion P1 of the screening plane P outside the screen 1.

In order to collect the largest residues that do not pass through the screening plane P, a second conveyor belt 22 is provided, arranged substantially transversely to the same advancement direction X, which receives the residues from the rotating shafts 3 at the output section 6 of the screen, and a third discharge belt 23 is provided, which is also arranged transversely to the advancement direction X, and is aligned with the second conveyor belt 22, from which it receives the residues to conduct them outside the screen.

Substantially, the second conveyor belt 22 serves to direct the residues from the advancement direction X i.e. main extension of the screen, to a transversal discharge direction which, as outlined hereinafter, is functional to the possibility of obtaining a residues circulation and treatment loop which involves a grinding or crushing system. The second conveyor belt 22 substantially has small dimensions, i.e. dimensions that allow it to substantially recede into the transversal overall size of the screen.

The three conveyor belts which—in the operative function of the screen—extend outside the support structure are advantageously of the telescopic type and can be displaced in a position approached to the support structure so as to take a minimum overall size position.

Figure 6:
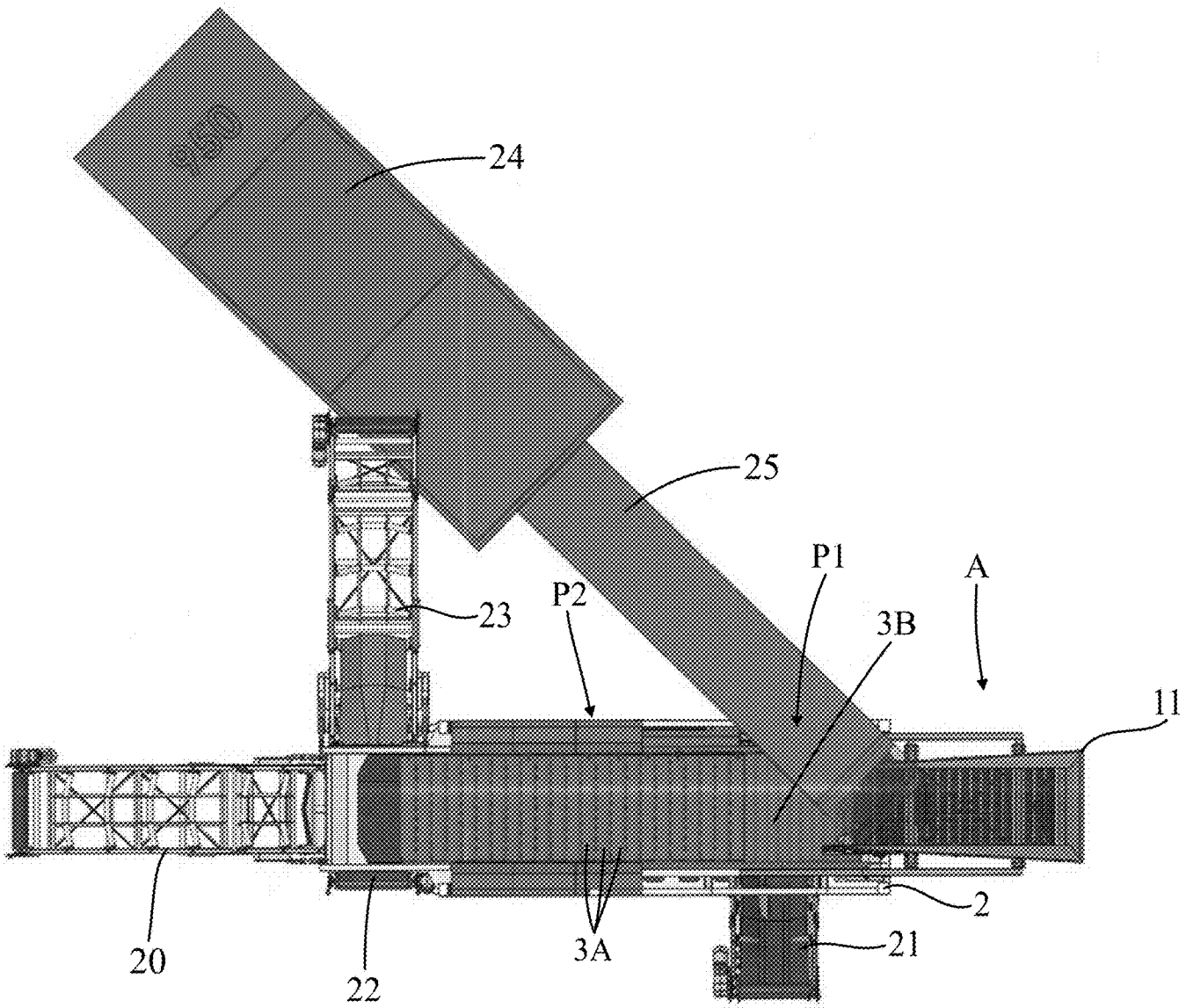
FIG. 6 shows a plan view of an example of a screen according to the present invention, associated to a grinding system.

Advantageously, according to the embodiment of FIG. 6, the larger residues that did not passed through the screening plane P can be treated several times in a closed loop. More in detail, according to an embodiment of the invention, the third discharge belt 23 is susceptible to discharge the residues received from the second conveyor belt 22 and coming from the output section 6 of the screening plane P, in a grinding and crushing system 24. Furthermore, the mobile hopper 11 is susceptible to receive the crushed residues of the grinding or crushing system 24 from a conveyor 25, so as to obtain a residues treatment loop. The treatment of the residues can also terminate when all has been ground to an extent of passing through the screening plane P.

The invention claimed is:

1. A disc screen for the separation of solid residues, which comprises:

a support structure;

a plurality of rotating shafts, wherein each shaft is extended along a corresponding longitudinal extension axis (Y); wherein said plurality of rotating shafts are parallel to each other, are rotatably mounted on said support structure, and define a screening plane (P); wherein said screening plane (P) is provided with an input section and with an output section, and has an elongated extension along a residue advancement direction (X) between said input section and said output section;

a drive system for driving said rotating shafts in order to carry said rotating shafts in rotation around the corresponding longitudinal extension axes (Y);

a plurality of discs axially mounted, in succession spaced from each other, along said rotating shafts;

a movable hopper, which is slidably mounted on said support structure along said residue advancement direction (X) and above said screening plane (P) by means of at least one track engaged by at least one corresponding guide; wherein said movable hopper is provided with an outlet door configured for supplying said screening plane (P) along said residue advancement direction (X);

a displacement system configured for moving said movable hopper along said residue advancement direction (X) in order to position the outlet door in different positions along the screening plane (P).

2. The disc screen of claim 1, wherein said displacement system comprise:

said at least one track mounted on said support structure and engaged by said at least one corresponding guide fixed to said movable hopper;

at least one linear actuator connected to said support structure and to said movable hopper to move said movable hopper along said residue advancement direction (X).

3. The disc screen of claim 1, wherein said plurality of rotating shafts comprises, starting from said input section:

a first set of rotating shafts, which are provided with a first screening section and define a first portion (P1) of said screening plane (P), and a second set of rotating shafts, which are provided with a second screening section and define a second portion (P2) of said screening plane (P);

wherein said first screening section is different from said second screening section.

4. A disc screen for the separation of solid residues, which comprises:

a support structure;

a plurality of rotating shafts, wherein each shaft is extended along a corresponding longitudinal extension axis (Y); wherein said plurality of rotating shafts are parallel to each other, are rotatably mounted on said support structure, and define a screening plane (P); wherein said screening plane (P) is provided with an input section and with an output section, and has an elongated extension along a residue advancement direction (X) between said input section and said output section;

a drive system for driving said rotating shafts in order to carry said rotating shafts in rotation around the corresponding longitudinal extension axes (Y);

a plurality of discs axially mounted, in succession spaced from each other, along said rotating shafts;

a movable hopper, which is slidably mounted on said support structure along said residue advancement direction (X) and above said screening plane (P); wherein said movable hopper is provided with an outlet door configured for supplying said screening plane (P) along said residue advancement direction (X);

a displacement system configured for moving said movable hopper along said residue advancement direction (X) in order to position the outlet door in different positions along the screening plane (P);

wherein said movable hopper comprises an auger mounted at said outlet door and arranged transversely to said residue advancement direction (X);

wherein the disc screen further comprises an electric motor configured for driving in rotation said auger in order to control flow rate of residues with which the screening plane (P) is to be loaded.

5. The disc screen of claim 4, wherein said movable hopper is provided with a bottom, so that said outlet door is defined between said bottom and said auger;

wherein said auger is mounted at an adjustable height with respect with said bottom to vary an area of said outlet door.

6. A disc screen for the separation of solid residues, which comprises:

a support structure;

a plurality of rotating shafts, wherein each shaft is extended along a corresponding longitudinal extension axis (Y); wherein said plurality of rotating shafts are parallel to each other, are rotatably mounted on said support structure, and define a screening plane (P); wherein said screening plane (P) is provided with an input section and with an output section, and has an elongated extension along a residue advancement direction (X) between said input section and said output section;

a drive system for driving said rotating shafts in order to carry said rotating shafts in rotation around the corresponding longitudinal extension axes (Y);

a plurality of discs axially mounted, in succession spaced from each other, along said rotating shafts;

a movable hopper, which is slidably mounted on said support structure along said residue advancement direction (X) and above said screening plane (P); wherein said movable hopper is provided with an outlet door configured for supplying said screening plane (P) along said residue advancement direction (X);

a displacement system configured for moving said movable hopper along said residue advancement direction (X) in order to position the outlet door in different positions along the screening plane (P);

wherein said plurality of rotating shafts comprises, starting from said input section:

a first set of rotating shafts, which are provided with a first screening section and define a first portion (P1) of said screening plane (P), and a second set of rotating shafts, which are provided with a second screening section and define a second portion (P2) of said screening plane (P);

wherein said first screening section is different from said second screening section;

wherein said displacement system is configured for moving said movable hopper between a first operative position (A), in which said movable hopper is configured for supplying the first portion (P1) of said screening plane (P), and a second operative position (B), in which said movable hopper is configured for supplying the second portion (P2) of said screening plane (P).

7. The disc screen of claim 6, further comprising:

a first conveyor belt arranged below the second portion (P2) of said screening plane (P) so as to receive residues which have passed through the second portion (P2) of the screening plane (P), and a first discharge belt which is aligned with said first conveyor belt, and is configured for receiving residues from said first conveyor belt so as to guide the residues outside said disc screen.

8. The disc screen of claim 7, further comprising a second discharge belt arranged below the first portion (P1) of said screening plane (P), and arranged transversely with respect to said residue advancement direction (X), so as to guide residues which have passed through the first portion (P1) of said screening plane (P) outside said disc screen.

9. The disc screen of claim 7, further comprising:

a second conveyor belt, which is arranged transversely to said residue advancement direction (X), and is configured for receiving the residues from the rotating shafts, and a third discharge belt, which is arranged transversely to said residue advancement direction (X), is aligned with said second conveyor belt, and is configured for receiving the residues from said second conveyor belt in order to guide the residues outside said disc screen.

10. The disc screen of claim 9, wherein said third discharge belt is configured for receiving, from said second conveyor belt, residues coming from the output section of said screening plane (P), and for discharging said residues into a grinding or crushing system;

wherein said movable hopper is configured for receiving crushed residues from said grinding or crushing system, so as to obtain a treatment loop of said residues.

* * * * *